US005297977A

United States Patent [19]

Lamper

[11] Patent Number: 5,297,977

[45] Date of Patent: Mar. 29, 1994

[54] PACKAGED SAFETY JUMPER ABLE

[76] Inventor: Maurice Lamper, 20 Harding Ave., Gonic, N.H. 03839

[21] Appl. No.: 780,125

[22] Filed: Oct. 21, 1991

[51] Int. Cl.[5] ..... H01R 11/00

[52] U.S. Cl. ..... 439/504; 320/26; 439/528

[58] Field of Search ..... 320/25, 26, 50, 51; 439/34, 188, 367, 488–491, 502–504, 506, 528, 892, 893

[56] References Cited

U.S. PATENT DOCUMENTS

| | | | |
|---|---|---|---|
| 3,973,202 | 8/1976 | Gardner | 320/26 |
| 4,653,833 | 3/1987 | Czubernat et al. | 439/528 |
| 4,721,479 | 1/1988 | Shuman | 439/504 |
| 4,904,205 | 2/1990 | Rice | 439/504 |
| 4,983,473 | 1/1991 | Smith | 439/504 |

*Primary Examiner*—Paula A. Bradley

*Attorney, Agent, or Firm*—Lee A. Strimbeck

[57] ABSTRACT

A packaged safety jumper cable comprised of two sets of cables, each set of which is comprised of a ground (negative) wire and a power (positive) wire and terminates at the outer end in clamps adapted to attach to the terminals of a battery. A container sized to hold the cables and clamps has an interior junction plate with electrical attachment points securing the inner ends of the cables. The ground wire and power wire of each set is connected such that in operation current can flow there between. A manual switch carried by the junction plate is interposed between and connects the power wires of the cables. The junction plate and switch are near the top of the container such that the switch is readily accessible. The clamps are suitably marked to indicate whether they are to be attached to the positives or negatives of the battery terminals.

4 Claims, 1 Drawing Sheet

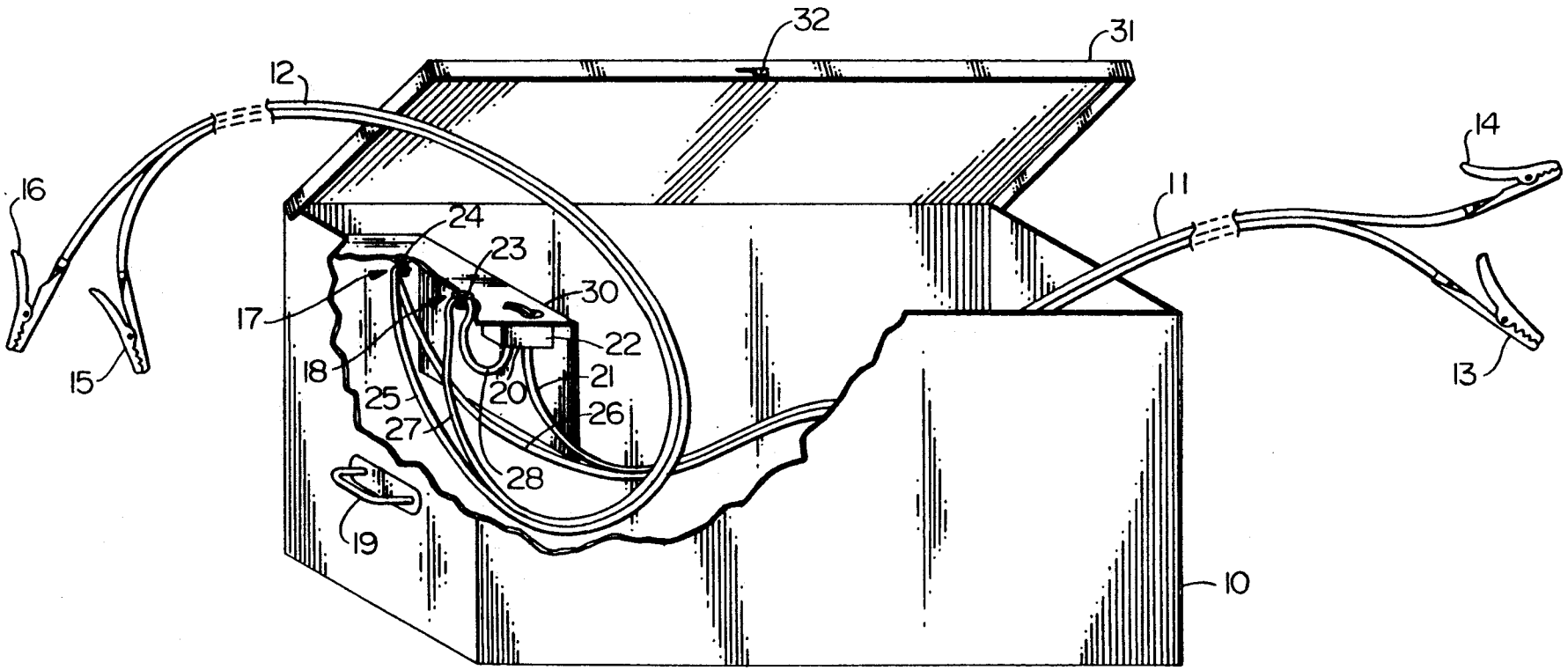
14
13
11
10
31
32
30
22
21
26
23
20
28
24
27
25
18
19
12
17
15
16

PACKAGED SAFETY JUMPER ABLE

This invention pertains to a jumper or booster cable apparatus packaged in a container that can conveniently be carried in an automobile. More particularly, this invention is a packaged safety jumper cable that has a manually operated switch in one of the lines so that current will not flow until after the clamps are affixed to the battery terminals and the switch is closed.

PRIOR ART

The following patents were turned up by a pre-examination search:

| Patent No. | Inventor |
|---|---|
| 4,163,134 | Budrose |
| 4,286,172 | Millonzi et al |
| 4,431,925 | Frisbee et al |
| 4,607,209 | Guim et al |
| 4,662,696 | Asbury |
| 4,906,205 | Viles |
| 4,972,135 | Bates et al |
| 4,969,834 | Johnson |

None of these references are concerned with a packaged jumper cable.

INTRODUCTION

It is often necessary to jump or boost a dead or low battery from the battery of another automobile, particularly in cold weather. As is known, this can be hazardous because of sparking when the clamps of the booster cables are affixed to the battery terminals. There can be gasoline fumes present from a flooded engine or carburetor which sparking can ignite. More often, hydrogen is generated in the battery being boosted and a spark may cause the battery to explode.

As shown in the above references, various schemes have been proposed to remove the operator of the cables from the vicinity of the automobile when the current is allowed to flow to the weak battery from the booster battery. A switch is placed in one of the lines, usually the positive line, permitting the operator to stand back from the engine compartment and throw the switch to a closed position allowing current to flow to the weak battery.

The present invention embodies this concept, but, in addition, proposes to package the cables in a container, in which the container contains a switch and necessary terminal connections to connect the cables going to the booster and weak batteries. Jumper cables are usually carried in the trunks of automobiles for quite some time with only infrequent use being made of them. If left loose in the trunk, besides being an annoyance, they tend to get damaged, especially the clamps for connecting to the battery terminals. By containing the cables, as proposed by this invention, the cables are protected and the container permits the cables to be carried in the automobile neatly and protected from physical abuse such as having jacks or other heavy items dropped on them.

In brief, the packaged safety jumper cable of this invention comprises two sets of cables, each set of which is comprised of a ground (negative) wire and a power (positive) wire and terminates at the outer end in clamps adapted to attach to the terminals of a battery. A container sized to hold the cables and clamps are provided. It has an interior junction plate with electrical attachment points securing the inner ends of the cables with the ground wire and power wire of each set being connected such that in operation current can flow there between. A manual switch carried by the junction plate is interposed between and connects the inner ends of the cables of the same polarity. Preferably, the switch is interposed between power wires of the cables and the junction plate and switch are near the top of the container such that the switch is readily accessible.

The clamps can be suitably marked to indicate whether they are to be attached to the positives or negatives of the battery terminals. Each of the sets of cables preferably has a length of at least eight feet.

THE DRAWING

The drawing illustrates one embodiment of the present invention, wherein a set of jumper cables are contained within a metal box.

DESCRIPTION

Referring to the drawing, illustrated is a rectangular metal box 10, although it could well have any other convenient shape such as cylindrical. The box contains a set of jumper cables 11 and 12, one being used to connect the booster battery and the other to connect the weak battery. The cables terminate in clamps for attaching to the battery terminals, in the case of cable 11, clamps 13 and 14, and for cable 12 clamps 15 and 16. These clamps may be suitably marked or colored to indicate whether they are to be connected to the ground (negative) or power (positive) terminals of the batteries.

The inner ends of the cables, as illustrated, terminate in the box at a junction plate 30 that has electrical attachment points or studs 23 and 24. One of the wires of each cable, usually the ground wires 25 and 26 of each, are directly connected to attachment point 24. The other wires 21 and 27 are connected together through a switch 22. As shown, wire 21 connects to one terminal of switch 22, the other terminal of switch 22 is connected by line 28 to stud 23 and line 27 of the other cable is directly connected to stud 23. Thus, when switch 22 is turned to the on position, the cables are directly connected.

Cables 11 and 12 are usually at least eight feet long and preferably are about twelve feet long. For cables of four gauge wire twelve feet long, the box can have a size of thirteen inches wide, eight inches deep and eleven inches high. This will permit storage of the cables without undue cramming.

Box 10 preferably has a good fitting lid 31 which preferably is hinged (not shown) and has a latch 32 to secure it. The box preferably has a handle 19 which handle may be on any surface or on the lid as may be convenient.

As suggested in the referenced patents, junction plate 30 may have additional accessories such as an indicator light and/or a circuit breaker to prevent an undue power surge. The box also can be of a size to allow the carrying of additional items such as starter fluid, small tools, safety glasses, a terminal brush and the like. It is contemplated that it would be convenient to sell the packaged jumper cables of this invention with such items in place so that the purchaser has a complete kit to attend to his/her start up or battery problems.

What is claimed is:

1. A package safety jumper cable comprising:

two sets of cables, each set having a ground (negative) wire and a power (positive) wire and each of said ground and power wires being of a heavy enough gauge to serve as a jumper cable and having an inner and an outer end with said outer end of each terminating in a clamp adapted to attach to a terminal of a battery;

a container sized to hold said cables and clamps and having therein a junction plate with electrical attachment points securing said inner ends of said ground and power wires of each said set such that in operation the current can flow there between; and a manual switch carried by said junction plate and being capable of carrying the amperage necessary for jump starting a vehicle and interposed between and operably connected to said inner end of one of the wires of each of said sets such that when said manual switch is closed in operation current can flow between said wires of each set of the same polarity.

2. The packaged safety jumper cable of claim 1 wherein said manual switch is interposed between the power wires of said cables and wherein said junction plate with said switch is near the top of said container with said switch being readily accessible.

3. The packaged safety jumper cable of claim 1 wherein said clamps are suitably marked to indicate whether said clamps are to be attached to the positive or negative terminals of a battery, wherein each of said sets of cables has a length of at least eight feet and wherein said wires are 4 gauge.

4. The packaged safety jumper cable of claim 3 wherein said container is a box with a latched lid and a handle for carrying.

* * * * *